US007560207B2

(12) United States Patent
Lee et al.

(10) Patent No.: US 7,560,207 B2
(45) Date of Patent: Jul. 14, 2009

(54) ORGANIC PHOTORECEPTOR AND ELECTROPHOTOGRAPHIC IMAGE FORMING APPARATUS INCLUDING THE PHOTORECEPTOR

(75) Inventors: Ji-young Lee, Suwon-si (KR); Beom-jun Kim, Yongin-si (KR)

(73) Assignee: Samsung Electronics Co., Ltd., Suwon-Si, Gyeonggi-do (KR)

( * ) Notice: Subject to any disclaimer, the term of this patent is extended or adjusted under 35 U.S.C. 154(b) by 267 days.

(21) Appl. No.: 11/606,226

(22) Filed: Nov. 30, 2006

(65) Prior Publication Data

US 2008/0014519 A1 Jan. 17, 2008

(30) Foreign Application Priority Data

Jul. 11, 2006 (KR) ..... 10-2006-0064973

(51) Int. Cl.
*G03G 5/047* (2006.01)
*G03G 5/05* (2006.01)

(52) U.S. Cl. ..... 430/59.1; 430/96; 399/159

(58) Field of Classification Search ..... 430/59.1, 430/96; 399/159
See application file for complete search history.

(56) References Cited

U.S. PATENT DOCUMENTS

| | | | | |
|---|---|---|---|---|
| 5,176,976 | A * | 1/1993 | Kikuchi et al. | 430/58.25 |
| 5,449,580 | A * | 9/1995 | Nakamori et al. | 430/58.25 |
| 6,228,546 | B1 * | 5/2001 | Kashizaki et al. | 430/58.25 |
| 7,083,883 | B2 * | 8/2006 | Kim et al. | 430/58.25 |

FOREIGN PATENT DOCUMENTS

| | | |
|---|---|---|
| JP | 9-281729 | 10/1997 |
| JP | 2000-204083 | 7/2000 |
| JP | 2002-148834 | 5/2002 |
| KR | 10-0462626 | 12/2004 |

* cited by examiner

*Primary Examiner*—John L Goodrow
(74) *Attorney, Agent, or Firm*—Roylance, Abrams, Berdo & Goodman, L.L.P.

(57) ABSTRACT

An organic photoreceptor and an electrophotographic image forming apparatus including the organic photoreceptor are provided. The organic photoreceptor has the same advantage as a conventional laminated photoreceptor but improved electric properties such as higher photosensitivity and lower exposure potential.

14 Claims, 1 Drawing Sheet

ORGANIC PHOTORECEPTOR AND ELECTROPHOTOGRAPHIC IMAGE FORMING APPARATUS INCLUDING THE PHOTORECEPTOR

CROSS-REFERENCE TO RELATED PATENT APPLICATION

This application claims the benefit of Korean Patent Application No. 10-2006-0064973, filed on Jul. 11, 2006, in the Korean Intellectual Property Office, the disclosure of which is hereby incorporated by reference in its entirety.

BACKGROUND OF THE INVENTION

1. Field of the Invention

The present invention relates to an organic photoreceptor and an electrophotographic image forming apparatus including the photoreceptor. More particularly, the invention relates to an organic photoreceptor having the same advantages as a conventional laminated photoreceptor but improved electric properties such as higher photosensitivity and lower exposure potential. The invention is also directed to an electrophotographic image forming apparatus including the photoreceptor.

2. Description of the Related Art

A two-layered organic photoreceptor used in an electrophotographic process includes a charge transporting layer (CTL) and a charge generating layer (CGL) placed on an electrically conductive substrate. Two-layered organic photoreceptors, are laminated organic photoreceptors and can be classified into positively charged organic photoreceptors, in which a CTL is formed on an electrically conductive substrate and a CGL is formed on the CTL to positively charge the surface of the photoreceptor, and negatively charged organic photoreceptors, in which a CGL is formed on an electrically conductive substrate and a CTL is formed on the CGL to negatively charge the surface of the photoreceptor.

The positively charged organic photoreceptor having the above described structure forms an electrophotographic image in the following manner.

First, when a surface of the organic photoreceptor is charged positively and a laser beam is radiated thereto, positive and negative charges are generated in the CGL. The positive charges are injected into the CTL by an applied electric field and move to the electrically conductive substrate, while negative charges (electrons) move to a surface of the CGL (that is, to a surface of an overcoating layer if an overcoating layer is coated on the surface of the CGL) and neutralize the surface charges. Consequently, the surface potential of the exposed portion is changed, and a latent image according to the changed surface potential is formed. When toner is developed on the latent image, a toner image is formed on the surface of the organic photoreceptor. The toner image is transferred to a surface of a receptor such as paper or other transferring medium.

In the case of the negatively charged organic photoreceptor, when a surface of the organic photoreceptor is charged with negative charges and a laser beam is radiated thereto, positive and negative charges are generated in the CGL. Then, the negative charges move to the electrically conductive substrate by an applied electric field, and the positive charges move to the CTL to neutralize the surface charges. As a result, the changed surface potential of the exposed portion is changed, and a latent image according to the changed surface potential is formed. When toner is developed on the latent image, a toner image is formed on the surface of the organic photoreceptor. The toner image is transferred to a surface of a receptor such as paper or other transferring medium.

Since the functions of the CTL and the CGL are different from each other, electric properties such as the charge potential and the exposure potential of the two-layer organic photoreceptor can be achieved more easily compared to a single-layered type organic photoreceptor where a series of electric properties have to be achieved using one single layer. Moreover, an electric field can be stably applied to a laminated organic photoreceptor even when the coating thickness of the CGL and the CTL is smaller. Accordingly, the laminated organic photoreceptor can keep more charges than a single-layered organic photoreceptor even when an electric field of the same intensity is applied, and thus a greater amount of toner can be developed on the surface of the organic photoreceptor. Accordingly, not only dry toner but also to wet toner can be used with the positive charge laminated organic photoreceptor.

However, the amount of a binder should be increased when coating a composition for forming a CGL on the electrically conductive substrate or a CTL in the laminated organic photoreceptor in order to increase the stability of the CGL coating solution, the coating quality of the CGL during coating, and the adhesion property between the CGL and the electrically conductive substrate or the CTL. However, when the binder amount in the composition for the CGL is great, the stability of the coating solution for the CGL, the coating quality, and the adhesion property are improved, but electric properties are significantly deteriorated. For example, the photosensitivity is decreased because electrons cannot be easily transported in the charge generating layer and the exposure potential is increased. Particularly, when the thickness of the CGL is increased to obtain high photosensitivity, charges are mainly generated in the upper portion of the CGL and thus electrons generated in the CGL have difficulty to efficiently move to the electrically conductive substrate or the CTL. Thus, the charges are not easily generated, the photosensitivity is decreased, and the exposure potential is increased.

SUMMARY OF THE INVENTION

The present invention provides an organic photoreceptor having the same advantages as a conventional laminated photoreceptor but improved electric properties.

The present invention also provides an electrophotographic image forming apparatus including the organic photoreceptor, an electrophotographic cartridge, and an electrophotographic drum.

According to an aspect of the present invention, an organic photoreceptor is provided which comprises: an electrically conductive substrate; and a laminated photosensitive layer comprising a charge generating layer (CGL) and a charge transporting layer (CTL), wherein the CGL includes an electron transporting polymer represented by Formula 1 below:

<Formula 1>

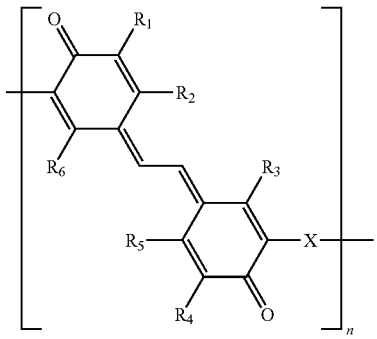

wherein $R_1$, $R_2$, $R_3$, $R_4$, $R_5$, and $R_6$ are each independently one selected from the group consisting of a hydrogen atom, a halogen atom, a hydroxyl group, a carboxyl group, a cyano group, a nitro group, a substituted or unsubstituted $C_1$-$C_{20}$ alkyl group, a substituted or unsubstituted $C_6$-$C_{30}$ aryl group, a substituted or unsubstituted $C_7$-$C_{30}$ aralkyl group, and a substituted or unsubstituted $C_1$-$C_{20}$ alkoxy group;

—X— is a single bond, —S—, —O—, —NH—, a substituted or unsubstituted C1-C20 alkylene group, a substituted or unsubstituted $C_1$-$C_{20}$ heteroalkylene group, a substituted or unsubstituted $C_2$-$C_{20}$ alkenylene group, a substituted or unsubstituted $C_2$-$C_{20}$ heteroalkenylene group, a substituted or unsubstituted $C_6$-$C_{30}$ arylene group, or a substituted or unsubstituted $C_7$-$C_{30}$ aralkylene group; and n is an integer from 5 through 1,000.

According to another aspect of the present invention, an image forming apparatus is provided comprising an organic photoreceptor comprising: an electrically conductive substrate; and a laminated photosensitive layer comprising a charge generating layer (CGL) and a charge transporting layer (CTL), wherein the CGL includes an electron transporting polymer represented by Formula 1.

According to another aspect of the present invention, an electrophotographic cartridge is provided comprising: an organic photoreceptor comprising: an electrically conductive substrate; and a laminated photosensitive layer comprising a charge generating layer (CGL) and a charge transporting layer (CTL), wherein the CGL includes an electron transporting polymer represented by Formula 1; and a charging device for charging the electrophotographic photoreceptor; a developing device for developing an electrostatic latent image formed on the electrophotographic photoreceptor; and a cleaning device for cleaning a surface of the electrophotographic photoreceptor, the electrophotographic cartridge being attachable to or detachable from an imaging apparatus.

According to another aspect of the present invention, there is provided an electrophotographic drum is provided having an organic photoreceptor comprising: an electrically conductive substrate; and a laminated photosensitive layer comprising a charge generating layer (CGL) and a charge transporting layer (CTL), wherein the CGL includes an electron transporting polymer represented by Formula 1, wherein the electrophotographic drum is attachable to or detachable from an imaging apparatus.

According to another aspect of the present invention, an image forming apparatus is provided comprising: a photoreceptor unit having an organic photoreceptor comprising: an electrically conductive substrate; and a laminated photosensitive layer comprising a charge generating layer (CGL) and a charge transporting layer (CTL), wherein the CGL includes an electron transporting polymer represented by Formula 1; a charging device for charging the photoreceptor unit; an imagewise light irradiating device for irradiating light onto the charged photoreceptor unit to form an electrostatic latent image on the photoreceptor unit; a developing unit for developing the electrostatic latent image with a toner to form a toner image on the photoreceptor unit; and a transfer device for transferring the toner image onto a receptor.

BRIEF DESCRIPTION OF THE DRAWING

The above and other features and advantages of the present invention will become more apparent by describing in detail exemplary embodiments thereof with reference to FIG. 1 illustrating an image forming apparatus, an electrophotographic drum, and an electrophotographic cartridge according to an embodiment of the present invention.

DETAILED DESCRIPTION OF THE INVENTION

Figure 1:
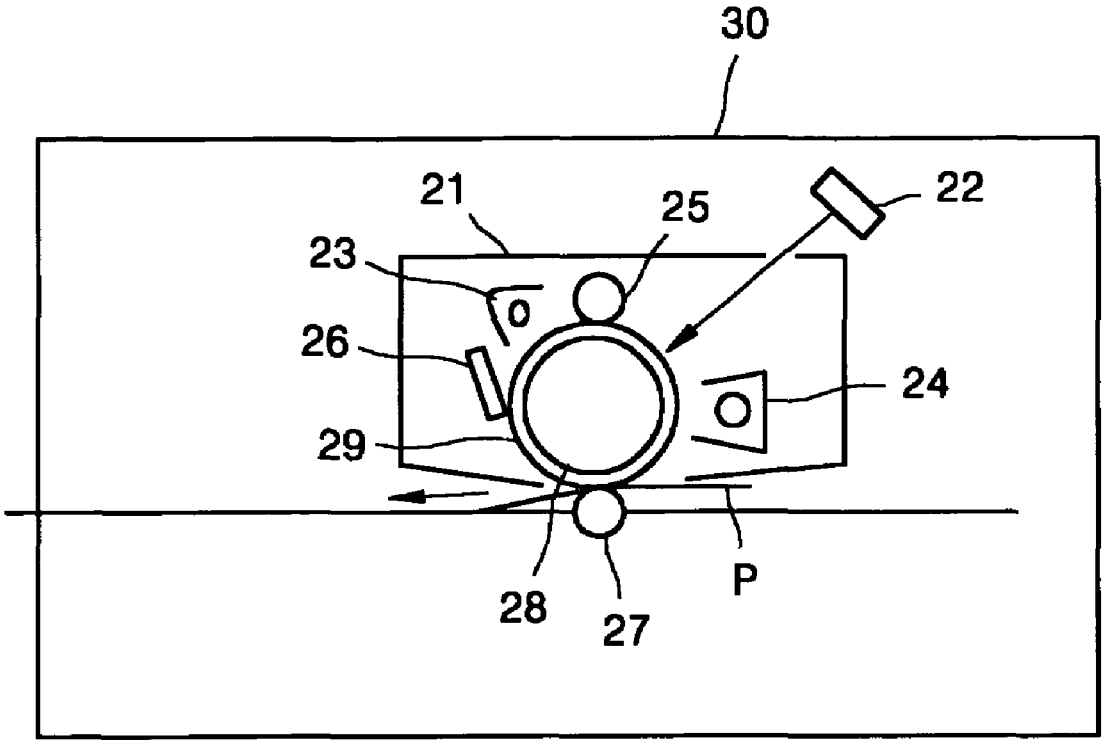

The present invention will now be described more fully with reference to the accompanying drawing, in which an exemplary embodiment of the invention is shown.

An organic photoreceptor according to an embodiment of the present invention includes a laminated photosensitive layer containing a charge generating layer (CGL) and a charge transporting layer (CTL) formed on an electrically conductive substrate, wherein the CGL includes an electron transporting polymer represented by Formula 1 shown below. Thus, the photosensitivity of the organic photoreceptor can be increased and the exposure potential can be reduced.

The organic photoreceptor according to the current embodiment of the present invention includes an electron-transporting polymer as a binder, where the electron-transporting polymer has the structure of Formula 1, and is not a conventional adhering binder resin. Thus, electrons generated in the CGL by light radiation can be easily and rapidly transported to the electrically conducive substrate or to the CTL, and the electrons can be easily injected into the electrically conductive substrate or the CTL from the CGL. In other words, an electron-transporting polymer is used as a binder in the CGL, and thus the amount of the binder resin in the composition ratio of the CGL increases. Thus, the coating solution for forming a CGL is stable, the coating quality and the adhesion property increase, and at the same time, the electron transport in the organic photoreceptor is improved, which leads to increase photosensitivity and the possibility to use a lower exposure potential.

A stilbenequinone derivative of Formula 1 below is used as a binder for the CGL in the current embodiment of the present invention:

<Formula 1>

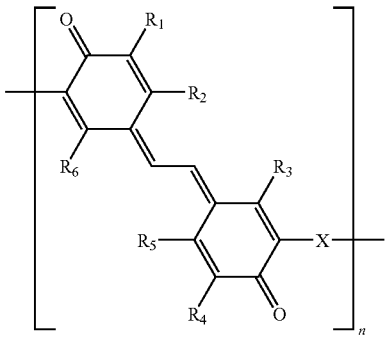

wherein $R_1$, $R_2$, $R_3$, $R_4$, $R_5$, and $R_6$ are each independently one selected from the group consisting of a hydrogen atom, a halogen atom, a hydroxyl group, a carboxyl group, a cyano group, an amino group, a nitro group, a substituted or unsubstituted $C_1$-$C_{20}$ alkyl group, a substituted or unsubstituted $C_6$-$C_{30}$ aryl group, a substituted or unsubstituted $C_7$-$C_{30}$ aralkyl group, and a substituted or unsubstituted $C_1$-$C_{20}$ alkoxy group;

—X— is a single bond, —S—, —O—, —NH—, a substituted or unsubstituted $C_1$-$C_{20}$ alkylene group, a substituted or unsubstituted $C_1$-$C_{20}$ heteroalkylene group, a substituted or unsubstituted $C_2$-$C_{20}$ alkenylene group, a substituted or unsubstituted $C_2$-$C_{20}$ heteroalkenylene group, a substituted or unsubstituted $C_6$-$C_{30}$ arylene group, or a substituted or unsubstituted $C_7$-$C_{30}$ aralkylene group; and n is an integer from 5 through 1,000.

In one embodiment of the electron transporting polymer of Formula 1, —X— may be a single bond or —O—, and $R_1$ and $R_4$ may be each independently a hydrogen atom or a C1-C12 alkylene group, and $R_2$, $R_3$, $R_5$, and $R_6$ may be each a hydrogen atom. Compounds of these structures are relatively simple to produce using known processes.

In another embodiment of the electron transporting polymer of Formula 1, $R_2$, $R_3$, $R_5$ and $R_6$ are hydrogen and X is a single bond, —$CH_2$—, —$CH(CH_3)$— or —$CH_2CH_2$—. In a further embodiment, $R_1$ and $R_4$ are independently selected from the group consisting of hydrogen, —$CH_3$—, —$C(CH_3)_3$—, —$CH_2CH_3$—, —$OCH_3$— and —$(CH_2)_7(CH_3)$—. In still another embodiment, the photoreceptor of Formula 1, $R_2$, $R_3$, $R_5$ and $R_6$ are hydrogen, $R_1$ and $R_4$ are independently selected from the group consisting of hydrogen, —$CH_3$—, —$C(CH_3)_3$—, —$CH_2CH_3$—, —$OCH_3$— and —$(CH_2)_7(CH_3)$—, and X is a single bond, —$CH_2$—, —$CH(CH_3)$—, —$CH_2CH_2$—, O and S.

Since materials having great and small molecular weights are mixed in the electron transporting polymer of Formula 1 due to the characteristics of a polymer, it is difficult to crystallize the electron transporting polymer even at a high concentration and crystals are not readily deposited therefrom, unlike a monomolecular material. Thus, when the electron transporting polymer of Formula 1 is used as a binder, the electron transporting material can be used at a high concentration. This generally improves problems related to the stability of the CGL, coating quality, and adhesion. In addition, the electron transportation is improved. In one embodiment of the invention, the electron transporting material of Formula 1 is used as the only binder in the CGL and CTL.

The electron transporting polymer of Formula 1 according to the current embodiment of the present invention can be obtained by refluxing methylene bisphenol in the presence of an oxidizing agent with an organic solvent for 5 to 48 hours. The oxidizing agent may be any material that can be used to obtain stilbenequinone by oxidizing phenol, such as manganese dioxide, chromic acid, permanganic acid, and other suitable oxidizing agents. The organic solvent may be a halogenated solvent, for example, chloroform, dichloromethane, or dichloroethane, or other suitable solvents.

The electron transporting polymer of Formula 1 according to the current embodiment of the present invention may have a number average molecular weight of about 500 through 100,000.

Hereinafter, Formulas 2 through 35 represent the preferably structures of compounds for the electron transporting polymer of Formula 1 where n is as defined above. However, the electron transporting polymer of Formula 1 is not limited thereto.

[Formula 2]

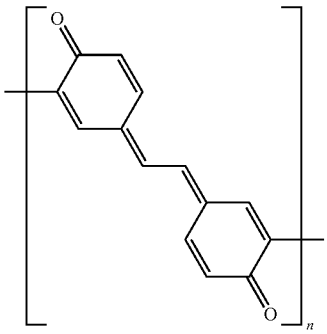

-continued

[Formula 3]

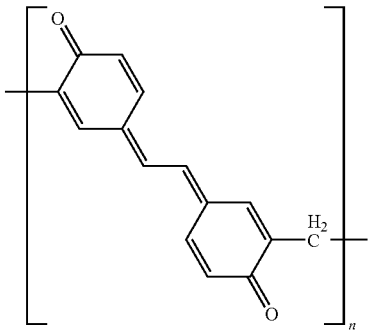

[Formula 4]

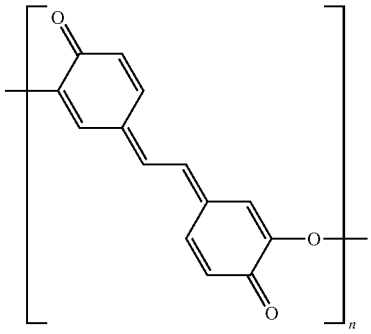

[Formula 5]

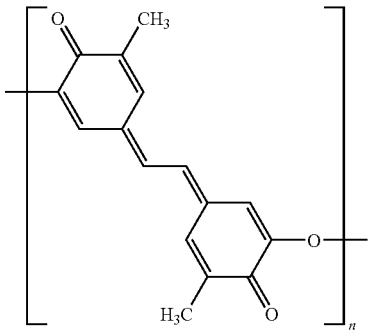

[Formula 6]

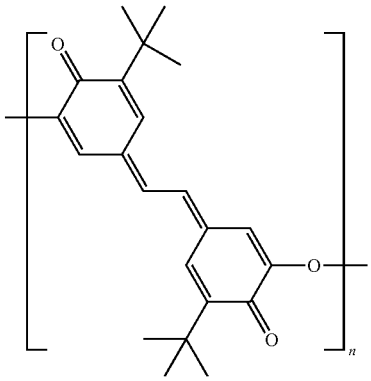

-continued
[Formula 7]
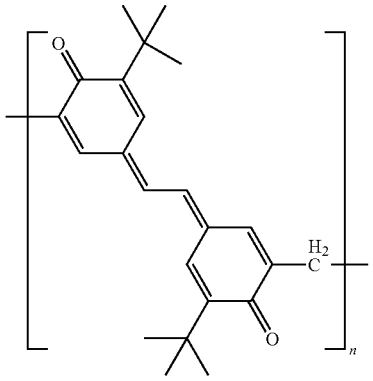
[Formula 8]
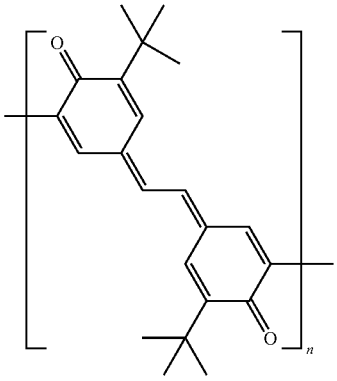
[Formula 9]
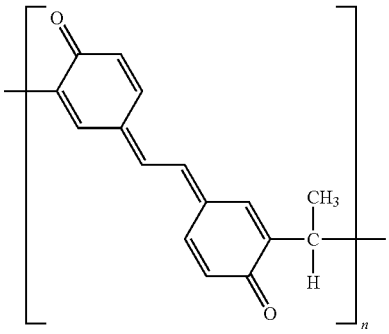
[Formula 10]
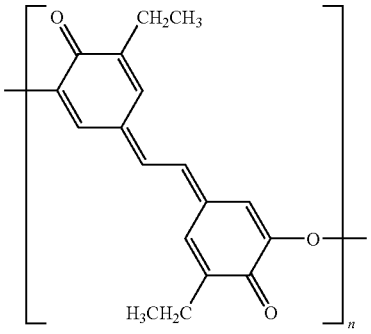
-continued
[Formula 11]
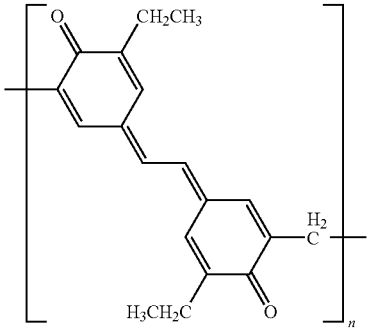
[Formula 12]
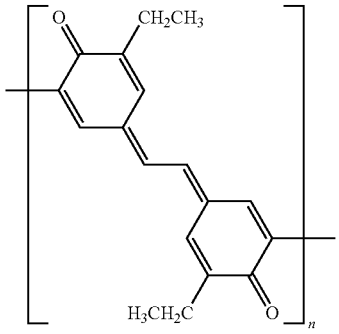
[Formula 13]
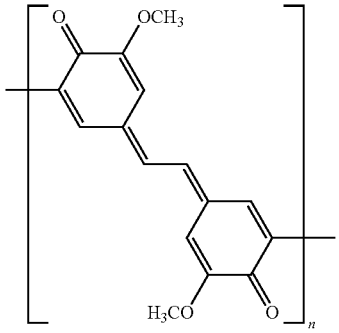
[Formula 14]
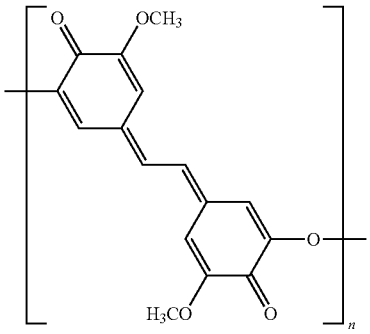

-continued
[Formula 15]
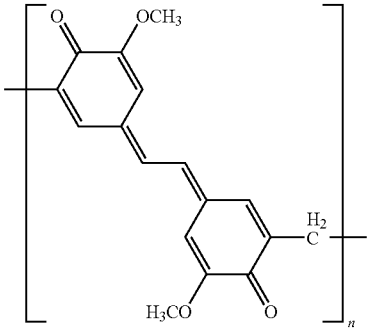
[Formula 16]
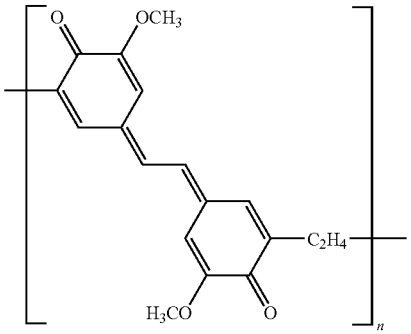
[Formula 17]
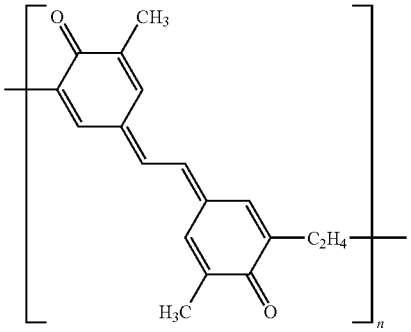
[Formula 18]
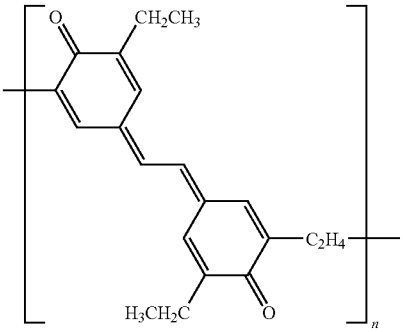
-continued
[Formula 19]
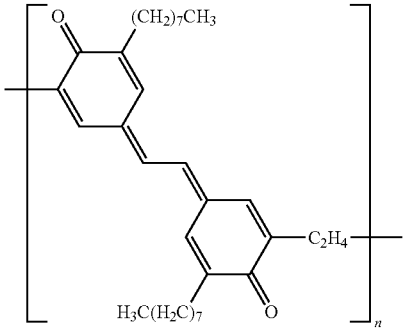
[Formula 20]
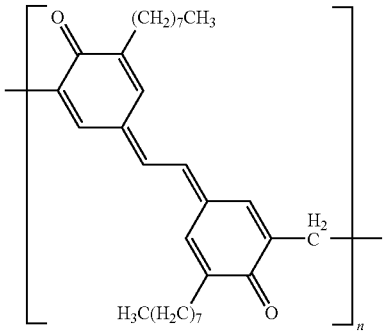
[Formula 21]
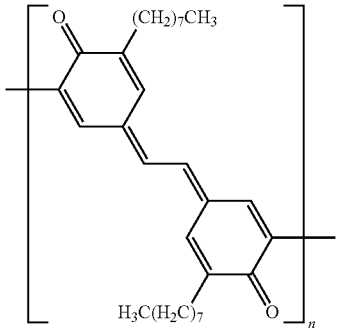
[Formula 22]
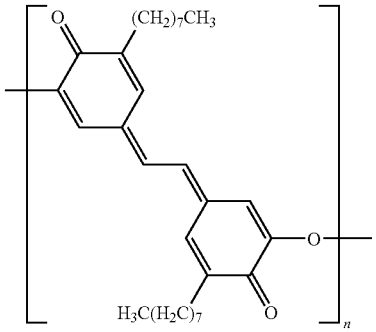

-continued
[Formula 23]
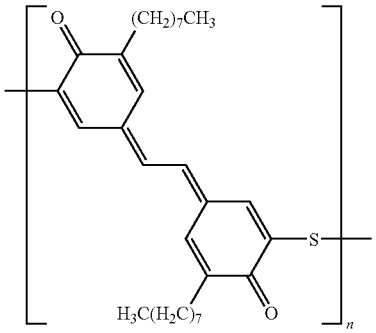
[Formula 24]
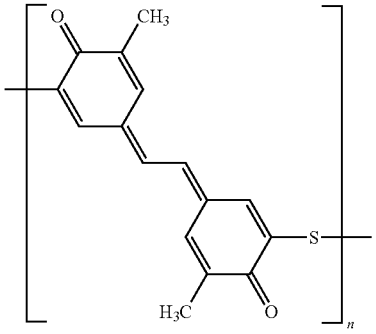
[Formula 25]
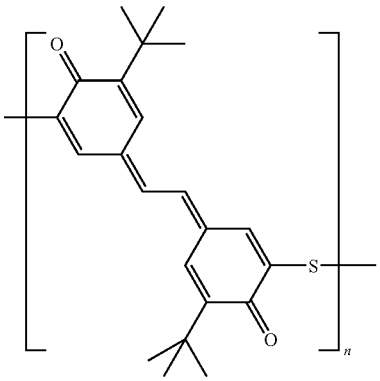
[Formula 26]
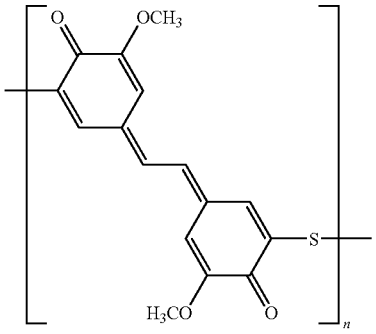
-continued
[Formula 27]
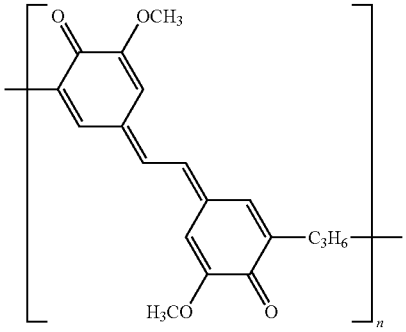
[Formula 28]
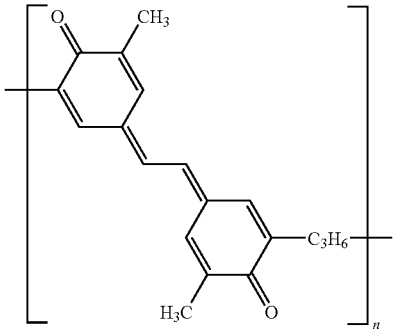
[Formula 29]
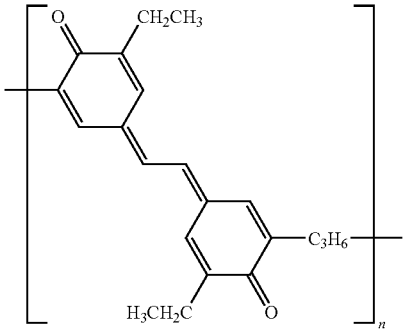
[Formula 30]
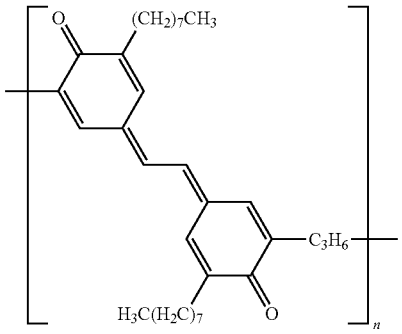

-continued

[Formula 31]

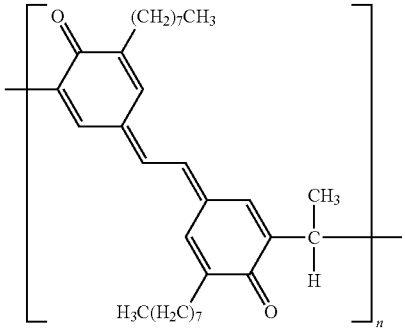

[Formula 32]

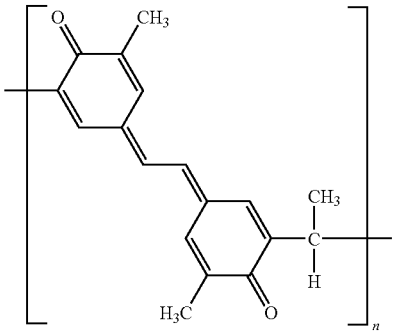

[Formula 33]

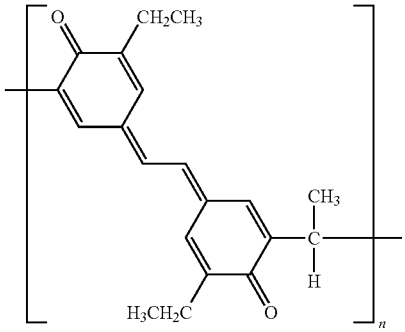

[Formula 34]

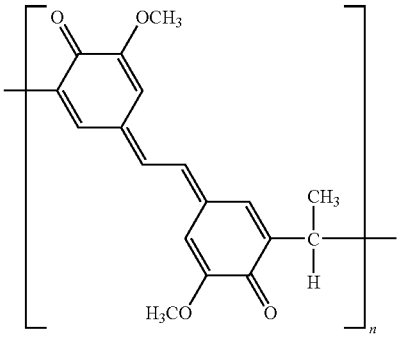

-continued

[Formula 35]

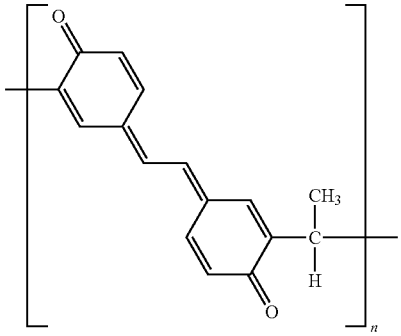

In various embodiments, $R_1$, $R_2$, $R_3$, $R_4$, $R_5$ and $R_6$ are each independently selected as defined above in Formula 1. In other embodiments, the resulting structure of Formula 1 is symmetrical where $R_1$ and $R_4$ are the same and $R_2$, $R_3$, $R_5$ and $R_6$ are the same. In further embodiments, $R_3$ and $R_6$ are the same and $R_2$ and $R_5$ are the same.

In general, an organic photoreceptor has a photosensitive layer coated on an electrically conductive substrate. Examples of the electrically conductive substrate used for the organic photoreceptor may be metals such as aluminum, aluminum alloy, stainless copper, copper, nickel, and other suitable metals. Also, an insulating substrate such as a polyester film, paper, glass, and the like, a surface of which is coated with a conductive layer such as aluminum, copper, palladium, tin oxide, indium oxide, or other conductive material, may be used. An anodized oxidization film using sulfuric acid solution or oxalate or a binder layer such as polyamide, polyurethane, epoxy resin, and the like, can be formed between the electrically conductive substrate and the photosensitive layer.

As described above, the photosensitive layer formed on the electrically conductive substrate is formed of a CTL and a CGL. In the positively charged photoreceptor, a CTL is formed on an electrically conductive substrate and a CGL is formed on the CTL. In the negatively charged photoreceptor, a CGL is formed on an electrically conductive substrate and a CTL is formed on the CGL.

The CTL for the photosensitive layer may be formed by treating a charge transporting material alone using liquid-coating, vacuum deposition, sputtering, a CVD method, or the like, or by liquid-coating the charge transporting material with a binder resin to increase the adhesion property or the intensity of the layers. When a binder resin is used, a charge transporting material having a high concentration is required to achieve the effects of the present invention, and thus the concentration of the charge transporting material may be at least 30 weight %. The thickness of the CTL may be from about 0.01 to 1 μm.

The amount of the charge transporting material in the photosensitive layer may be about 10 to 60 weight % based on the total weight of the CTL. When the amount of the charge transporting material is less than 10 weight %, the charge transporting ability is not sufficient. When the amount of the charge transporting material is greater than 60 weight %, the amount of the binder resin in the photosensitive layer is reduced, which is likely to reduce the mechanical intensity.

The charge transporting material can be classified into a hole transporting material and an electron transporting material. The hole transporting material is used as a charge transporting material for a negative charge laminated photoreceptor, and the electron transporting material is used as a charge transporting material for a positive charge laminated photoreceptor. When the laminated photoreceptor needs to be bipolar, i.e., positively charged or negatively charged depending on the situation, a combination of a hole transporting material and an electron transporting material can be used. If the charge transporting material has a film forming ability, it can be used without any modification. However, a material does not usually have a film forming ability in a low molecular state, thus the material is dissolved in a resin having a film forming ability, and this mixed solution is coated on the CGL or the electrically conductive substrate and dried thereafter to complete a CTL. The thickness of the CTL may vary according to the purpose, and may be preferably from about 5 to 20 μm.

Among the charge transporting materials used in the present invention, examples of the hole transporting material may be known materials in the field and include a hydrazone compound, a pyrazolin compound, an oxadiazol compound, a styryl compound, an arylamine compound, an oxazole compound, a pyrazolin compound, a pyrazolone compound, a stilbene compound, a polyaryl alkane compound, a polyvinyl carbazole compound and derivatives thereof, an N-acrylamidemethyl carbazole copolymer, a chinochisarine polymer, a vinyl polymer, a triphenylmethane polymer, a stylene copolymer, a polyacenaphthene, polyindene, a copolymer of acenaphthylene and styrene, and a formaldehyde condensation resin.

Examples of the hole transporting material for a charge transporting material may be known materials in the field and include a benzoquinone compound, a naphthoquinone compound, an anthraquinone compound, a malononitrile compound, a fluorenone compound, a dicyanofluorenone compound, a benzoquinoneimine compound, a diphenoquinone compound, a stilbenequinone compound, a diiminoquinone compound, a dioxotetracenedione compound, a thiopyran compound, and the like. However, the charge transporting material used in the present invention is not limited to the hole transporting material or the electron transporting material, and any material having a charge mobility of $10^{-8}$ $cm^2/s$ or greater may be used. In addition, the charge transporting material may be used in combination of at least two materials.

The binder resin that can be used in the CTL may be a polymer that can form an electrically insulating film. Examples of the polymer include, but are not limited to, polycarbonate, polyester, methacrylic resin, acrylic resin, polyvinyl chloride, polyvinylidene chloride, polystyrene, polyvinyl acetate, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehide resin, a stylene-alkyd resin, a poly-N-vinyl carbazole, polyvinyl butyral, polyvinyl formal, polysulfone, casein, gelatin, polyvinyl alcohol, ethyl cellulose, a phenol resin, polyamide, carboxymethyl cellulose, vinylidene chloride polymer latex, polyurethane, and the like. Such binder resin can be used alone or in combination of at least two materials.

The CTL can be coated using a conventional liquid coating method such as a spray coating method, a ring coating method, a roll coating method, and the like, which are appropriate for manufacturing of an electrophotographic photoreceptor of the present invention.

The CGL for the photosensitive layer can be obtained by dispersing a charge generating material in a solvent with a compound of Formula 1 used as a binder and by coating the same.

The amount of compound of Formula 1 used as the binder may be about 20 to 80 weight % to the total weight of the CGL. When the amount of the compound of Formula 1 is less than 20 weight %, a sufficient coating quality and adhesion property cannot be obtained. When the amount of compound of Formula 1 is greater than 80 weight %, the amount of the charge generating material is reduced, and thus the photosensitivity is likely to decrease.

Examples of the charge generating material include organic pigments such as an azo pigment, a quinone pigment, a perylene pigment, an indigo pigment, a thioindigo pigment, a bisbenzoimidazole pigment, a phthalocyanine pigment, a quinacridone pigment, a quinoline pigment, a lake pigment, an azolake pigment, an anthraquinone pigment, an oxazine pigment, a dioxazine pigment, a triphenyl methane pigment, an azulenium pigment, a squarium pigment, a prylium pigment, a trialyl methane pigment, a xanthene pigment, a thiazine pigment, a cyanine pigment, and the like, or inorganic pigments such as amorphous silicone, amorphous selenium, telulium, selenium-telenium alloy, cadmium sulfide, antimone sulfide, zinc oxide, zinc sulfide, and the like. The charge generating material can be used alone or in combination of at least two materials. The amount of the charge generating material may be about 20 to 80 weight % based on the total weight of the CGL. When the amount of the charge generating material is less than 20 weight %, the amount of the charge generating material is decreased, thereby decreasing the photosensitivity. When the amount of the charge generating material is greater than 80 weight %, a sufficient coating quality and adhesion property cannot be obtained.

The organic photoreceptor according to the current embodiment of the present invention further includes an undercoat on the electrically conductive substrate besides the CTL and the CGL in order to facilitate charge generation and charge transportation. The undercoat is formed of a metal oxide, a binder resin, and an antioxidant. The metal oxide may be selected from tin oxide, indium oxide, zinc oxide, titanium oxide, silicon oxide, zirconium oxide, aluminum oxide, and the like, and may be used alone or in combination of at least two materials. Examples of the binder resin that can be used for the undercoat include a thermosetting resin that is obtained by thermally polymerizing an oil-free alkyd resin, an amino resin such as butylated melamine resin, a photocurable resin that is obtained by polymerizing a resin having an unsaturated bond such as unsaturated polyester or unsaturated polyurethane, a polyamide resin, a polyurethane resin, an epoxy resin, and the like, which may be used alone or in combinations of at least two materials. Preferably, a rutile titanium oxide may be used as the binder resin, and about 0.01 to 5% of aluminum oxide with respect to the weight of the titanium oxide may be used in combination to improve the electrostatic properties and maintain the smoothness of a printed image.

The thickness of the undercoat may be about 0.1 to 20 μm, preferably about 0.2 to 10 μm. When the thickness of the undercoat is less than 0.1 μm, the undercoat is damaged due to the highly charged voltage, which causes perforation, and thus, black spots are created in the image. When the thickness of the undercoat is greater than 20 μm, it is difficult to control the electrostatic properties and the image quality is deteriorated. The weight ratio of the metal oxide and the binder resin of the undercoat may be in the range of about 0.1/1 to about 10/1. When the ratio of the binder is too high, the shield effect by the metal oxide is decreased. When the ratio of the metal oxide is too high, the adhesion force when coated on the electrically conductive substrate is decreased.

A solvent for the coating solution used for manufacturing an undercoat, a CGL, or a CTL of the organic photoreceptor of the present invention varies according to the kind of the used resin. Preferably, the solvent does not affect adjacent layers may be selected. Specifically, examples of suitable solvents include aromatic hydrocarbons, such as benzene, xylene, ligroin, monochlorobenzene, and dichlorobenzene; ketones, such as acetone, methylethyl ketone, and cyclohexanone; alcohols, such as methanol, ethanol, and isopropanol; esters, such as ethyl acetate and methyl cellosolve; halogenated aliphatic hydrocarbons, such as carbon tetrachloride, chloroform, dichloromethane, dichloroethane, and trichloroethylene; ethers, such as tetrahydrofuran, dioxane, dioxolane, ethylene glycol, and monomethyl ether; amides, such as N,N-dimethyl formamide and N,N-dimethyl acetamide; and sulfoxides, such as dimethylsulfoxide.

Besides the mixed composition of the present invention, other known charge generating materials or a dye/pigment for adjusting the spectroscopic photosensitivity can be used together for manufacturing a CGL or a CTL. Examples of the material that can be used herein include a bisazo compound, a triazo compound, an anthraquinone compound, a perinone compound, an azulenium salt compound, a squarium salt compound, polycyclo quinone, and pthalocyanine such as a pyrrolo pyrrole compound and naphthalocyanine.

In general, the total thickness of the photosensitive layer may be defined in the range of about 5 to 50 μm.

Also, the CGL and/or CTL forming the photosensitive layer may further include a dispersion stabilizer, a plasticizer, a surface modifier, an antioxidant, a photodeterioration inhibitor, and the like. The amount of the additives above may be about 0.01 to 20 weight % with respect to the total weight of the photosensitive layer.

Examples of the plasticizer include biphenyl, chlorinated biphenyl, terphenyl, dibutyl phthalate, diethylene glycol phthalate, dioctyl phthalate, triphenyl phosphite, methylnaphthalene, benzophenone, chlorinated paraffin, polypropylene, polystyrene, various fluorinated hydrocarbons, and the like.

Examples of the surface modifier include silicone oil, fluorine resin, and the like.

Examples of the antioxidant include a conventional antioxidant such as a hindered phenol compounds, sulfide, a phosphonic acid ester compound, a phosphorous acid ester compound, and an amine compound. Examples of the phenol based antioxidant include, but are not limited to, 2,6-di-tert-butylphenol, 2,6-di-tert-butyl-4-methoxyphenol, 2,6-di-tert-butyl-4-methyl phenol, 2-tert-butyl-4-methoxyphenol, 2,4-dimethyl-6-tert-butylphenol, 2-tert-butylphenol, 3,6-di-tert-butylphenol, 2,4-di-tert-butylphenol, 2,6-di-tert-butyl-4-ethylphenol, 2-tert-butyl-4,6-methyl phenol, 2,4,6-tert-butylphenol, 2,6-di-tert-butyl-4-stearyl propionate phenol, α-tocopherol, β-tocopherol, γ-tocopherol, naphtol AS, naphtol AS-D, naphtol AS-BO, 4,4'-methylenebis (2,6-di-tert-butylphenol), 4,4'-methylenebis(6-tert-butyl-4-methyl phenol), 2,2'-methylenebis(4-methyl-6-tert-butylphenol), 2,2'-methylenebis (4-ethyl-6-tert-butylphenol), 2,2'-ethylene bis(4,6-di-tert-butylphenol), 2,2'-propylene bis (4,6-di-tert-butylphenol), 2,2'-butane bis(4,6-di-tert-butylphenol), 2,2'-ethylene bis (6-tert-butyl-m-cresol), 4,4'-butane bis(6-tert-butyl-m-cresol), 2,2'-butane bis ((6-tert-butyl-p-cresol), 2,2'-thiobis ((6-tert-butylphenol), 4,4'-thiobis(6-tert-butyl-m-cresol), 4,4'-thiobis(6-tert-o-cresol), 2,2'-thiobis(4-methyl-6-tert-butylphenol), 1,3,5-trimethyl-2,4,6-tris(3,5-di-tert-butyl-4-hydroxybenzyl) benzene, 1,3,5-trimethyl-2,4,6-tris(3,5-di-tert-amyl-4-hydroxybenzyl) benzene, 1,3,5-trimethyl-2,4,6-tris (3-tert-butyl-5-methyl-4-hydroxybenzyl) benzene, 2-tert-butyl-5-methyl-phenyl amine phenol, 4,4'-bis amino(2-tert-butyl-4-methyl phenol), n-octadecyl-3-(3',5'-di-tert-butyl-4'-hydroxyphenyl) propionate, 2,2,4-trimethyl-6-hydroxy-7-tert-butyl chroman, tetrakis(methylene-3-(3,5-di-tert-butyl-4-hydroxyphenyly propionate) methane, 1,1,3-tris (2-methyl-4-hydroxy-5-tert-butylphenyl) butane, and others. The compounds can be used in combination of two or more.

Examples of the photodeterioration inhibitor include a benzotriazole compound, a benzophenone compound, a hindered amine compound, and the like.

Also, the electrophotographic photoreceptor according to an embodiment of the present invention may further include an intermediate layer or a surface protecting layer when necessary.

An electrophotographic imaging apparatus, an electrophotographic photoreceptor drum, and an electrophotographic cartridge including the electrophotographic photoreceptor according to the present invention will now be described in detail.

FIG. 1 schematically illustrates an image forming apparatus 30 including an electrophotographic photoreceptor drum 28, and an electrophotographic cartridge 21 according to an embodiment of the present invention. The electrophotographic cartridge 21 typically includes an electrophotographic photoreceptor 29, one or more charging devices 25 for charging the electrophotographic photoreceptor 29, a developing device 24 for developing an electrostatic latent image formed on the electrophotographic photoreceptor 29, and a cleaning device 26 for cleaning a surface of the electrophotographic photoreceptor 29. The electrophotographic cartridge 21 can be attached to and detached from the image forming apparatus 30.

The electrophotographic photoreceptor drum 28 of the image forming apparatus 30 can generally be attached to and detached from the image forming apparatus 30 and includes the drum 28 on which the electrophotographic photoreceptor 29 is placed.

Generally, the image forming apparatus 30 includes a photosensitive unit (for example, the drum 28 and the electrophotographic photoreceptor 29); the charging device 25 for charging the photoreceptor unit; an imagewise light irradiating device 22 for irradiating light onto the charged photoreceptor unit to form an electrostatic latent image on the photoreceptor unit; the developing unit 24 for developing the electrostatic latent image with a toner to form a toner image on the photoreceptor unit; and a transfer device 27 for transferring the toner image onto a receiving material, such as paper P, and the photoreceptor unit includes the electrophotographic photoreceptor 29, which will be described below. The charging device 25, as a charging unit, may be supplied with a voltage and may charge the electrophotographic photoreceptor 29. The image forming apparatus 30 may also include a pre-exposure unit 23 to erase a residual charge from the surface of the electrophotographic photoreceptor 29 in order to prepare for a next printing cycle.

The organic photoreceptor according to an embodiment of the present invention can be integrated into electrophotographic image forming apparatuses such as laser printers, photocopiers, and facsimile machines.

Hereinafter, the present invention will be described in detail with reference to the following examples. However, these examples are for illustrative purposes only and are not intended to limit the scope of the invention.

EXAMPLE 1

20 parts by weight of a charge generating material of Formula 41 (y—TiOPc, titanyl oxy phthalocyanine), 20 parts by weight of electron transporting polymer of Formula 42, and 760 parts by weight of THF were sand-milled and dispersed using ultrasonic waves. The obtained solution was coated on an anodized aluminum drum and dried at 120° C. for 20 minutes to form a CGL.

<Formula 41>

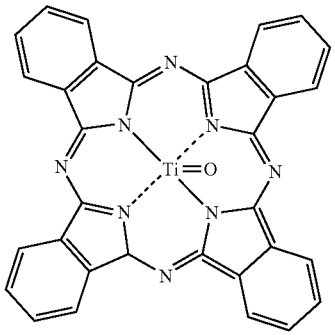

<Formula 42>

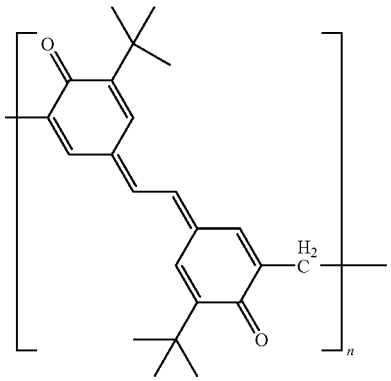

(number average molecular weight: about 15,400)

45 parts by weight of the hole transporting material of Formula 43 and 55 parts by weight of the binder resin (PCZ) of Formula 44 were dissolved in 426 parts by weight of a THF/toluene mixed solvent (weight ratio: 4/1) and coated on the CGL and dried at 120° C. for 30 minutes to form a CTL.

<Formula 43>

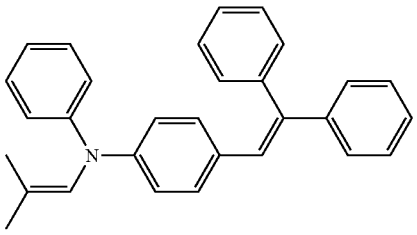

-continued

<Formula 44>

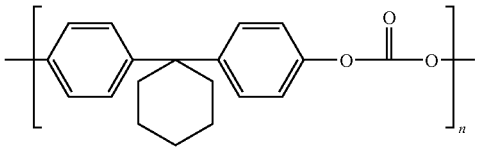

The thickness of the photosensitive layer of the organic photoreceptor was about 20 μm.

EXAMPLE 2

An organic photoreceptor was manufactured in the same manner as in Example 1, except that the content of the electron transporting polymer of Formula 2 was 15 parts by weight, and the content of THF was 620 parts by weight.

COMPARATIVE EXAMPLE 1

20 parts by weight of a charge generating material of Formula 41 (y—TiOPc, titanyl oxy phthalocyanine); 20 parts by weight of the binder resin of Formula 45 (polyvinyl butyral (PVB)), and 1300 parts by weight of THF were sand-milled for 2 hours and dispersed using ultrasonic waves. The obtained solution was coated on an anodized aluminum drum and dried at 120° C. for 20 minutes to form a CGL.

<Formula 45>

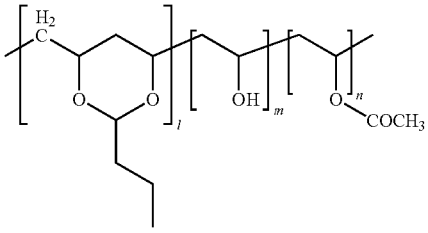

(l:m:n = 81:17:2)

45 parts by weight of the hole transporting material of Formula 43 and 55 parts by weight of the binder resin (PCZ) of Formula 44 were dissolved in 426 parts by weight of a THF/toluene mixed solvent (weight ratio: 4/1) and coated on the obtained CGL and dried at 120° C. for 30 minutes to form a CTL.

The thickness of the photosensitive layer of the organic photoreceptor was about 20 μm.

COMPARATIVE EXAMPLE 2

An organic photoreceptor was manufactured in the same manner as in Example 1, except that the content of the PVB of Formula 45 was 15 parts by weight, and the content of THF was 950 parts by weight.

Electrophotographic properties of the organic photoreceptors prepared in Examples 1 and 2 and Comparative Examples 1 and 2 were measured using a photoreceptor evaluation apparatus ("PDT-2000" manufactured by QEA). To measure the electrophotographic properties, a voltage was applied such that the charge potential value ($V_o$) was 800 V at a relative speed of the charging device and the photoreceptor of 100 mm/sec. Immediately thereafter, a monochromatic light having a wavelength of 780 nm was radiated onto the organic photoreceptor and the surface potential value of the organic photoreceptor was recorded, and the relationship between the exposure energy and the surface potentials of the organic photoreceptor was measured.

The composition of the Example 1 and 2, and Comparative Example 1 and 2 are listed in Table 1. And, the results are listed in Table 2.

TABLE 1

| | Amount of the charge generating material (parts by weight) | Amount of the binder (parts by weight) | Type of the binder |
|---|---|---|---|
| Example 1 | 20 | 20 | Compound of Formula 42 |
| Example 2 | 20 | 15 | Compound of Formula 42 |
| Comparative Example 1 | 20 | 20 | PVB |
| Comparative Example 2 | 20 | 15 | PVB |

TABLE 2

| Properties | $E_{1/2}$ | $E_{200}$ | $E_{0.25}$ | $E_{0.5}$ |
|---|---|---|---|---|
| Example 1 | 0.094 | 0.156 | 70 | 28 |
| Example 2 | 0.092 | 0.154 | 62 | 23 |
| Comparative Example 1 | 0.104 | 0.185 | 132 | 84 |
| Comparative Example 2 | 0.101 | 0.172 | 95 | 48 |

$E_{1/2}$: light energy necessary for photosensitivity, surface potential to be ½
$E_{200}$: light energy necessary for surface potential to be 200 V
$E_{0.25}$: surface potential when light energy of 0.25 uJ/cm$^2$ was radiated
$E_{0.5}$: surface potential when light energy of 0.5 uJ/cm$^2$ was radiated As evident from Table 2, Examples 1 and 2 show overall lower values of $E_{1/2}$, $E_{200}$, $E_{0.25}$, and $E_{0.5}$ than Comparative Examples 1 and 2.

Example 1, wherein the same composition ratio as in Comparative Examples 1 and 2 was used and an electron transporting polymer of Formula 42 was used as a binder of a CGL, shows overall lower values $E_{1/2}$, $E_{200}$, $E_{0.25}$, and $E_{0.5}$ compared to Comparative Examples 1 and 2 in which a conventional polyvinyl butyral was used. This is thought to be caused by the electrons generated in the upper portion of the CGL easily flowing through an electron transporting polymer to the electrically conductive substrate.

As evident from the above described results, the organic photoreceptor according to the present invention has the same advantages as a conventional single-layered photoreceptor and at the same time, has higher photosensitivity and low exposure potential, which are useful for an electrophotographic image forming apparatus.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An organic photoreceptor comprising:

an electrically conductive substrate; and a laminated photosensitive layer comprising a charge generating layer (CGL) and a charge transporting layer (CTL) including a charge transporting material and a binder resin, wherein the CGL includes a binder resin and charge generating material, and where the binder resin is an electron transporting polymer represented by Formula 1 below:

<Formula 1>

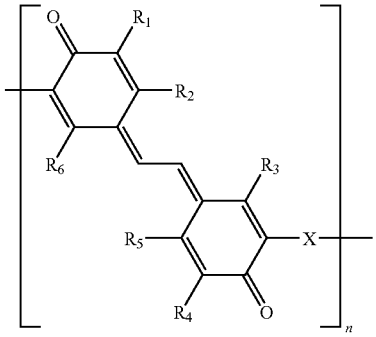

wherein $R_1$, $R_2$, $R_3$, $R_4$, $R_5$, and $R_6$ are each independently one selected from the group consisting of a hydrogen atom, a halogen atom, a hydroxyl group, a carboxyl group, a cyano group, a nitro group, a substituted or unsubstituted $C_1$-$C_{20}$ alkyl group, a substituted or unsubstituted $C_6$-$C_{30}$ aryl group, and a substituted or unsubstituted $C_7$-$C_{30}$ aralkyl group, and a substituted or unsubstituted $C_1$-$C_{20}$ alkoxy group;

—X— is a single bond, —S—, —O—, —NH—, a substituted or unsubstituted $C_1$-$C_{20}$ alkylene group, a substituted or unsubstituted $C_1$-$C_{20}$ heteroalkylene group, a substituted or unsubstituted $C_2$-$C_{20}$ alkenylene group, a substituted or unsubstituted $C_2$-$C_{20}$heteroalkenylene group, a substituted or unsubstituted $C_6$-$C_{30}$ arylene group, or a substituted or unsubstituted $C_7$-$C_{30}$ aralkylene group; and n is an integer from 5 through 1,000.

2. The organic photoreceptor of claim 1, wherein —X— is a bond or —O—, and $R_1$ and $R_4$ are each independently a hydrogen atom or a $C_1$-$C_{12}$ alkylene group, and $R_2$, $R_3$, $R_5$, and $R_6$ are each a hydrogen atom.

3. The organic photoreceptor of claim 1, wherein the compound of Formula 1 is the compounds of Formulae 2 through 35 below

[Formula 2]

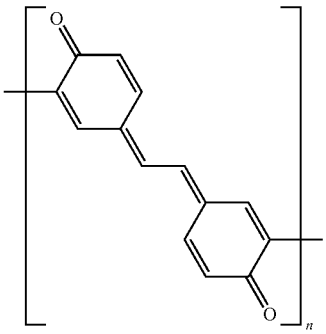

-continued
[Formula 3]
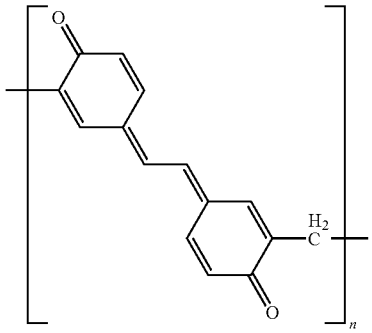
[Formula 4]
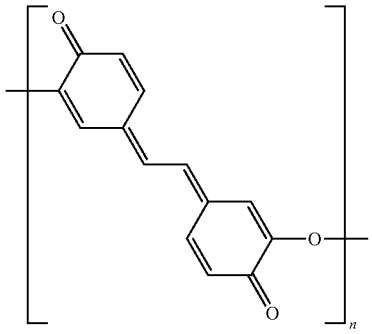
[Formula 5]
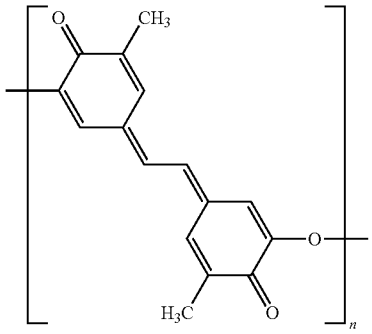
[Formula 6]
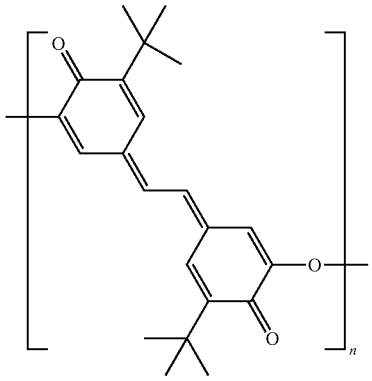
-continued
[Formula 7]
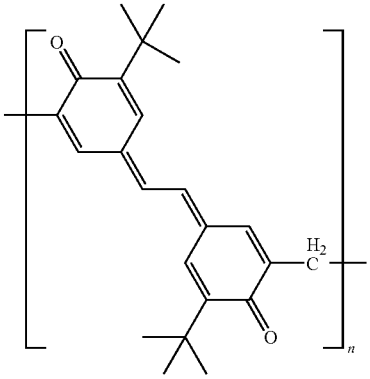
[Formula 8]
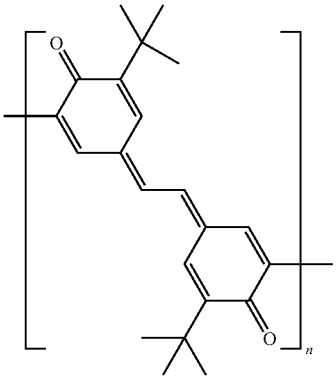
[Formula 9]
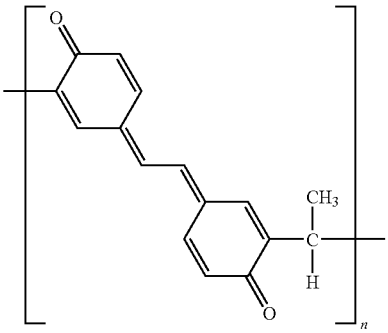
[Formula 10]
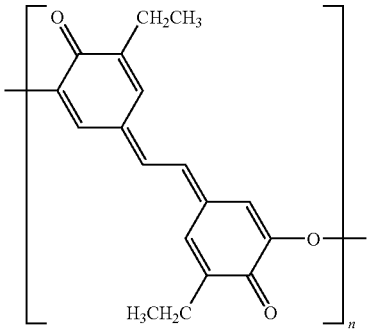

-continued
[Formula 11]
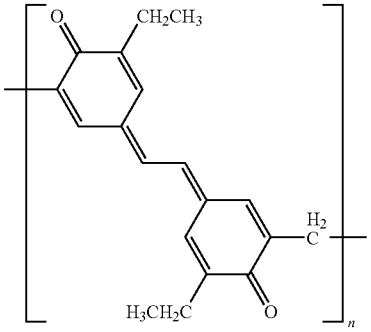
[Formula 12]
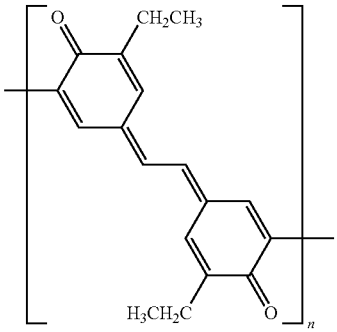
[Formula 13]
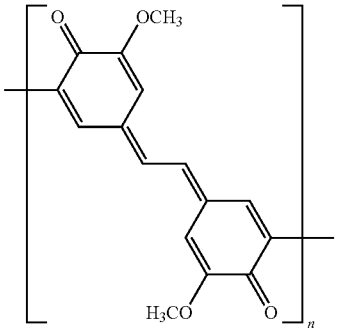
[Formula 14]
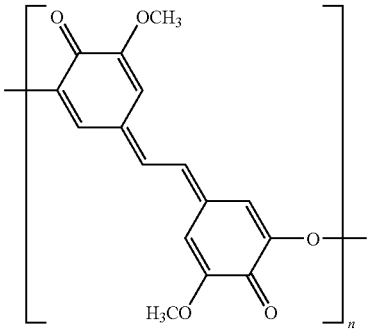
-continued
[Formula 15]
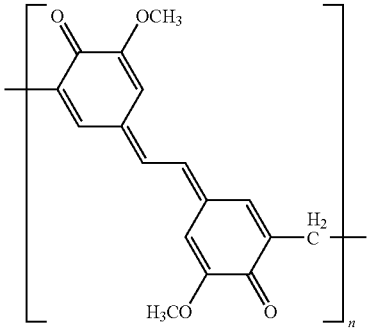
[Formula 16]
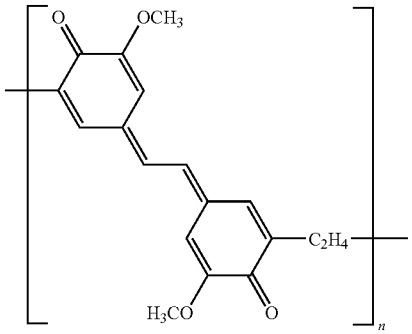
[Formula 17]
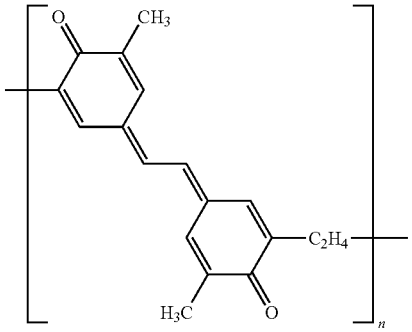
[Formula 18]
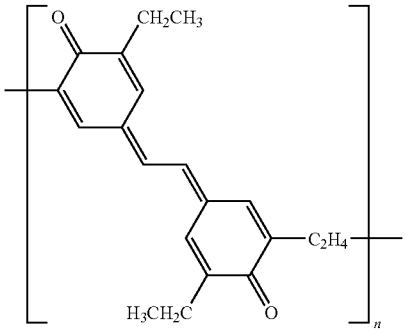

-continued
[Formula 19]
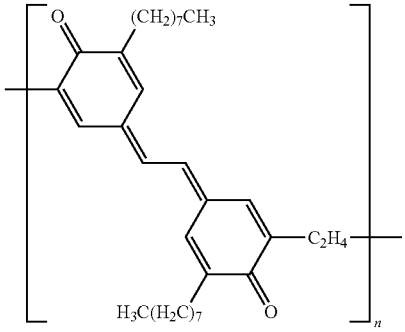
[Formula 20]
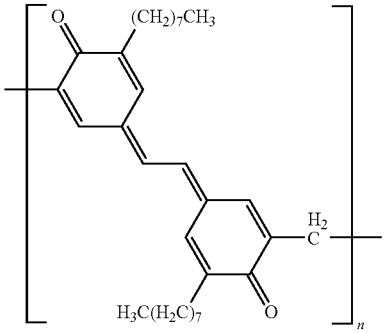
[Formula 21]
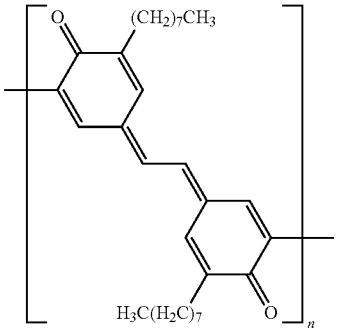
[Formula 22]
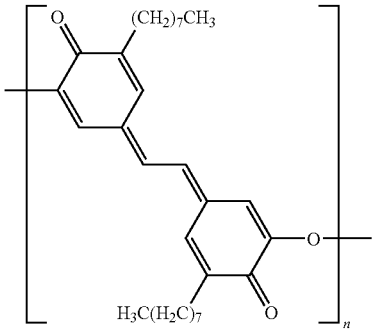
-continued
[Formula 23]
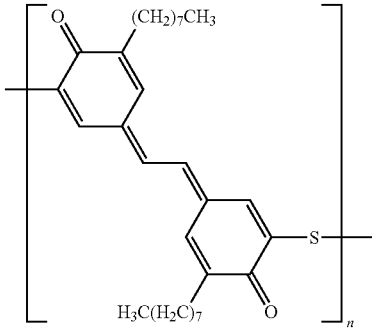
[Formula 24]
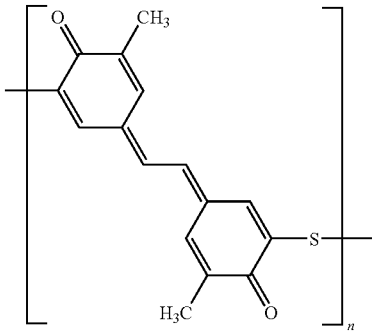
[Formula 25]
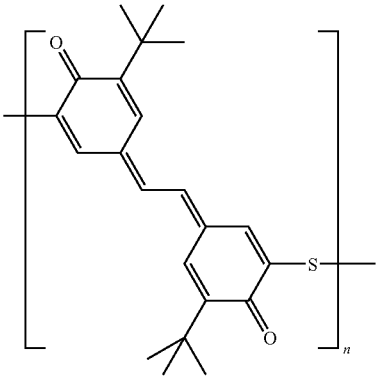
[Formula 26]
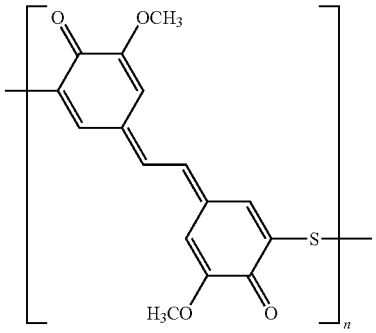

-continued
[Formula 27]
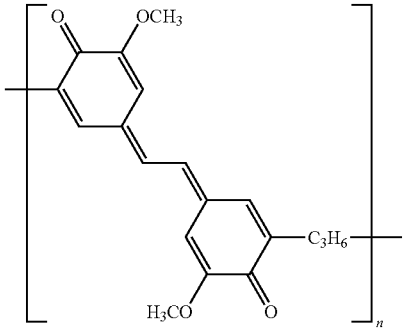
[Formula 28]
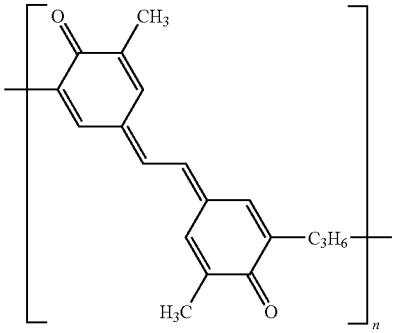
[Formula 29]
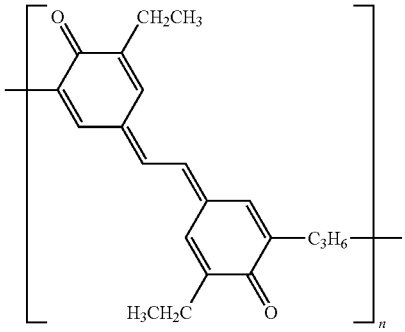
[Formula 30]
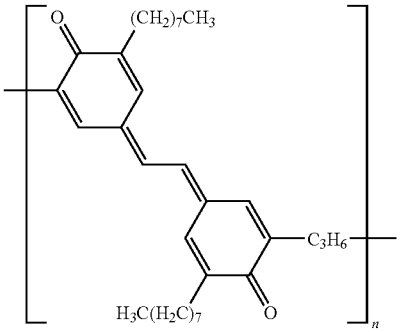
-continued
[Formula 31]
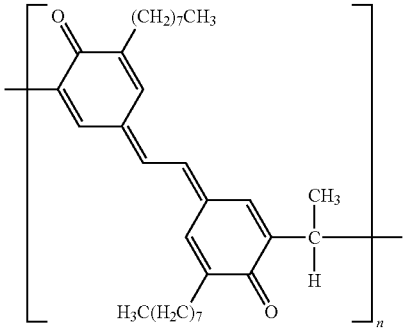
[Formula 32]
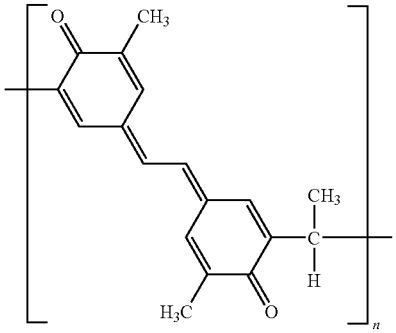
[Formula 33]
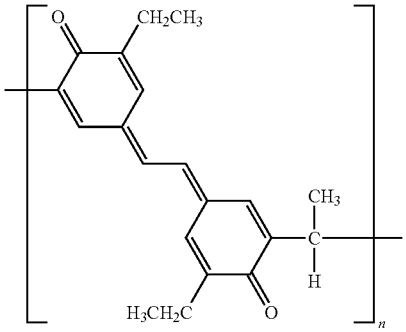
[Formula 34]
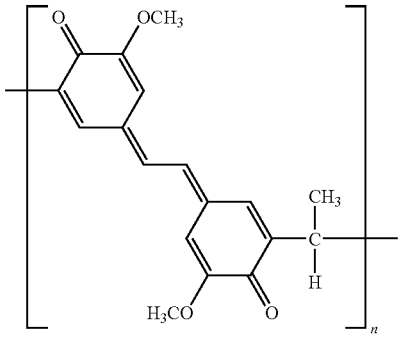

-continued

[Formula 35]

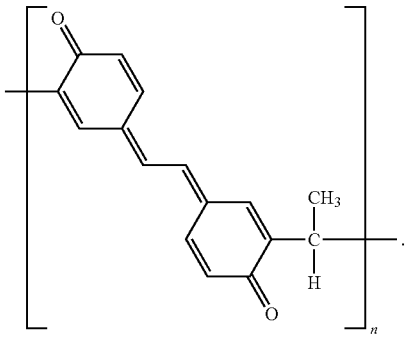

4. The organic photoreceptor of claim 1, wherein the amount of the compound of Formula 1 is about 20 to 80 weight % based on the total weight of the CGL.

5. The organic photoreceptor of claim 1, further comprising an undercoat on the electrically conductive sudstrate.

6. The organic photoreceptor of claim 1, wherein the at least one charge generating material is selected form the group consisting of organic pigments, inorganic pigments, and mixtures thereof.

7. The organic photoreceptor of claim 1, wherein the charge generating material is included in the CGL in an amount of about 20 wt % to about 80 wt % based on the total weight of the CGL.

8. The organic photoreceptor of claim 1, wherein $R_2$, $R_3$, $R_5$ and $R_6$ are hydrogen, and X is a single bond —$CH_2$—, —$CH(CH_3)$—, or —$CH_2CH_2$—.

9. The organic photoreceptor of claim 8, whererin $R_1$ and $R_4$ are independently selected from the group consisting of hydrogen, —$CH_3$—, —$C(Ch_3)_3$—, —$CH_2CH_3$—, —$OCH_3$— and —$(CH_2)_7CH_3$—.

10. The organic photoreceptor of claim 1, wherein $R_2$, $R_3$, $R_5$ and $R_6$ are hydrogen, $R_1$ and $R_4$ are independently selected from the group consisting of hydrogen, —$CH_3$—, —$C(CH_3)_3$, —$CH_2CH_3$—, —$OCH_3$— and —$(CH_2)_7CH_3$—, and X is a single bond, —$CH_2$—, —$CH(CH_3)$—, —$CH_2CH_2$—, O and S.

11. The organic photoreceptor of claim 1, wherein the organic photoreceptor is a negatively charged type, and wherein a CGL is first formed and then a CTL is formed on the electrically conductive substrate in the laminated photosensitive layer.

12. An electrophotographic cartridge comprising:

an organic photoreceptor of claim 1;

a charging device for charging the electrophotographic photoreceptor;

a developing device for developing an electrostatic latent image formed on the electrophotographic photoreceptor; and a cleaning device for cleaning a surface of the electrophotographic photoreceptor, wherein the electrophotographic cartridge is attachable to or detachable from an imaging apparatus.

13. An electrophotographic drum comprising an organic photoreceptor of claim 1, wherein the electrophotographic drum is attachable to or detachable from an imaging apparatus.

14. An image forming apparatus comprising:

a photoreceptor unit comprising an organic photoreceptor of claim 1;

a charging device for charging the photoreceptor unit;

an imagewise light irradiating device for irradiating light onto the charged photoreceptor unit to form an electrostatic latent image on the photoreceptor unit;

a developing unit for developing the electrostatic latent image with a toner to form a toner image on the photoreceptor unit; and a transfer device for transferring the toner image onto a receptor.

* * * * *